US006528473B1

(12) United States Patent
Lannibois-Drean et al.

(10) Patent No.: US 6,528,473 B1
(45) Date of Patent: Mar. 4, 2003

(54) SYSTEM-GRANULATES COMPRISING A HYDROPHOBIC ORGANIC ACTIVE SUBSTANCE ENCAPSULATED IN AN ALKALI-WATER SOLUBLE SOLID ORGANIC POLYMER

(75) Inventors: Hélène Lannibois-Drean, Charenton Le Pont (FR); Mikel Morvan, Asnieres (FR); Daniel Joubert, Vineuil-Saint Firmin (FR)

(73) Assignee: Rhodia Chimie, Boulogne Billancourt Cedex (FR)

( * ) Notice: Subject to any disclaimer, the term of this patent is extended or adjusted under 35 U.S.C. 154(b) by 0 days.

(21) Appl. No.: 09/601,417

(22) PCT Filed: Feb. 2, 1999

(86) PCT No.: PCT/FR99/00212

§ 371 (c)(1),
(2), (4) Date: Sep. 1, 2000

(87) PCT Pub. No.: WO99/38944

PCT Pub. Date: Aug. 5, 1999

(30) Foreign Application Priority Data

Feb. 2, 1998 (FR) ..... 98 01160

(51) Int. Cl.[7] ..... C11D 17/08; C11D 3/37

(52) U.S. Cl. ..... 510/442; 510/441

(58) Field of Search ..... 510/441, 443, 510/444, 442

(56) References Cited

U.S. PATENT DOCUMENTS

| | | | | |
|---|---|---|---|---|
| 3,666,680 | A | 5/1972 | Briggs | 252/316 |
| 4,384,096 | A | 5/1983 | Sonnabend | 526/313 |
| 4,759,956 | A | 7/1988 | Amer | 427/213 |
| 5,419,846 | A | 5/1995 | Jaekel | 252/99 |

FOREIGN PATENT DOCUMENTS

| | | | |
|---|---|---|---|
| EP | 0 468 824 | 1/1992 | C11D/11/00 |
| EP | 0 633 310 | 1/1995 | C11D/3/37 |

OTHER PUBLICATIONS

International Search Report

*Primary Examiner*—John Hardee

(57) ABSTRACT

The invention concerns solid granulates of a system comprising at least a hydrophobic organic active substance (for example an active detergent substance) encapsulated in solid particles of an alkali-water soluble organic polymer derived by emulsion polymerisation, said particles being dispersed in and encapsulated by a matrix in a water soluble or water dispersible dry organic compound. The invention also concerns the use of said granulates in detergent compositions, in particular for cleaning hard surfaces or for washing clothes and the detergent compositions.

28 Claims, No Drawings

SYSTEM-GRANULATES COMPRISING A HYDROPHOBIC ORGANIC ACTIVE SUBSTANCE ENCAPSULATED IN AN ALKALI-WATER SOLUBLE SOLID ORGANIC POLYMER

The present invention relates to dry solid granules of a system comprising particles of at least one hydrophobic organic active material (for example a detergent active material) encapsulated in solid particles of an alkali-water-soluble organic polymer obtained by emulsion polymerization, said particles being dispersed in and encapsulated by a matrix made of a water-soluble or water-dispersible dry organic compound; the invention is also directed toward a process for preparing said granules, as well as toward the use of said granules as additives, in particular detergent additives, in compositions intended for an alkaline aqueous medium or capable of forming an alkaline aqueous medium with water, in particular in detergent compositions; the invention is also directed toward detergent compositions comprising said additive.

The expression "detergent active material" means any active material which may be present in a detergent composition.

Active materials, such as biocides, bleaching activators, optical brighteners, anti-UV agents, antioxidants, bleaching catalysts, etc. may be present and may pose problems, either on account of their physical state (liquid to be adsorbed onto a support, in the case of washing powders) or on account of stability or corrosiveness with respect to other additives of the formulation in which they are contained.

The Applicant has found a system for encapsulating hydrophobic organic active materials, in particular detergent hydrophobic active materials, which allows the active material to be released essentially only in alkaline medium, for example during the washing of laundry.

A first subject of the invention consists of water-dispersible dry solid granules (G) of a system (S) comprising particles (pS), said particles (pS) comprising at least one hydrophobic organic active material (AM) encapsulated in solid particles (pAS) of an alkali-water-soluble organic polymer (AS) obtained by emulsion polymerization of at least one ethylenically unsaturated anionic monomer which can undergo radical-mediated polymerization and of at least one ethylenically unsaturated nonionic comonomer which can undergo radical-mediated polymerization, the amount of said anionic monomer(s) representing at least 10%, preferably at least 20%, most particularly from 25% to 60%, by weight of the total amount of monomers, said particles (pS) being dispersed in and encapsulated by a matrix made of at least one water-soluble or water-dispersible dry solid organic compound (MO), at least 0.1% by weight of at least one emulsifier relative to the weight of alkali-water-soluble copolymer (AS) being present at the interface: matrix (MO)/particles (pS) of system (S).

Any active material, whether solid or liquid (in native form or dissolved in a solvent), is suitable for the invention provided that it is immiscible or only very sparingly miscible with water.

The term "sparingly miscible" refers to active materials whose solubility in water at pH 7 does not exceed 20% by weight, preferably not 10% by weight.

Hereinbelow, the expression "active material" will be understood as referring to either a pure active material in its native form or in a solvent, or a mixture of active materials in their native forms or in a solvent.

Examples of active materials (AM) which may be mentioned are detergent hydrophobic active materials such as, for example, bleaching catalysts, biocides, bleaching activators, anti-UV agents, optical brighteners and antioxidants.

Examples of biocides which may be mentioned are bactericides (triclosan, etc.) and fungicides.

Examples of bleaching activators which may be mentioned are those which generate a peroxycarboxylic acid in the washing medium, such as tetraacetyl-ethylenediamine, tetraacetylmethylenediamine, etc.

Examples of optical brighteners which may be mentioned are stilbene or pyrazoline derivatives, coumarin, fumaric acid, cinnamic acid, azoles, methinecyanins and thiophenes.

Examples of anti-UV agents.or antioxidants which may be mentioned are vanillin and its derivatives.

Examples of bleaching catalysts which may be mentioned are derivatives of manganese or other metals, such as those described in U.S. Pat. No. 5,246,621, U.S. Pat. No. 5,244,594, U.S. Pat. No. 5,194,416, U.S. Pat. No. 5,114,606, EP-A-549 271, EP-A-549 272, EP-A-544 440, EP-A-544 490, U.S. Pat. No. 4,430,243, U.S. Pat. No. 5,114,611, U.S. Pat. No. 4,728,455, U.S. Pat. No. 5,284,944 and U.S. Pat. No. 5,246,612 etc.

The amount of active material (AM) which may be present in said particles (pS) of the system (S) can range from 20 to 70 and preferably from 40 to 60 parts by weight of active material (AM) per 100 parts by weight of alkali-water-soluble polymer (AS).

The expression "alkali-water-soluble polymer" (AS) means a polymer capable of dissolving or dispersing in an aqueous medium with a pH of greater than 7, preferably with a pH of at least 9.5 at a temperature from about 20° C. to 90° C. This polymer is not water-soluble at a pH below 7.

Said alkali-water-soluble polymers (AS) derive from at least one ethylenically unsaturated anionic monomer which can undergo a radical-mediated polymerization and from at least one ethylenically unsaturated nonionic comonomer which can undergo radical-mediated polymerization.

Examples of anionic monomers which may be mentioned are:

- α,β-ethylenically unsaturated carboxylic acids, such as acrylic acid, methacrylic acid, maleic acid, itaconic acid, etc.,
- α,β-ethylenically unsaturated sulfone-containing monomers, such as vinylbenzene sulfonate, etc.

Needless to say, the content of anionic monomer depends on the hydrophilicity of this monomer.

Said anionic monomers are preferably carboxylic monomers.

Examples of nonionic monomers which may be mentioned are:

- vinylaromatic monomers: styrene, vinyltoluene, etc.,
- alkyl esters of α,β-ethylenically unsaturated acids: methyl, ethyl, etc. acrylates and methacrylates,
- vinyl or allyl esters of saturated carboxylic acids, acetates, propionates, etc.,
- vinyl or vinylidene halides: chlorides, etc.,
- conjugated aliphatic dienes, butadiene, etc.,
- α,β-ethylenically unsaturated nitriles: acrylonitrile, etc.,
- hydroxyalkyl esters of α,β-ethylenically unsaturated acids: hydroxyethyl, hydroxypropyl, etc. acrylates and methacrylates,
- α,β-ethylenically unsaturated acid amides: acrylamide, methacrylamide, etc.

Said alkali-water-soluble polymers (AS) can also be derived from a monomer composition also containing at least one polyfunctional crosslinking comonomer (MR) (containing at least two ethylenic unsaturations) and/or at least one ethylenically unsaturated nonionic amphiphilic comonomer (MG) capable of forming grafted copolymers with the other comonomers.

Said polyfunctional crosslinking comonomer(s) (MR) can represent from about 0.01% to 1%, preferably from 0.01% to 0.5%, of all of the monomers in the monomer composition.

Examples of crosslinking comonomers (MR) which may be mentioned are:

glyoxal bis acrylamide ethylene glycol diacrylate or dimethacrylate trimethylolpropane trimethacryalate, pentaerithrityl triacrylate polyallyl ethers of ethylene glycol, of glycerol, of pentaerithritol or of diethylene glycol allyl acrylate divinylbenzene, trivivylbenzene and alkyldivinylbenzenes divinyl ether The said grafting nonionic amphiphilic comonomer(s) (MG) can represent up to 20% of all of the monomers.

Examples of grafting amphiphilic comonomers (MG) which may be mentioned are those of formula $$CH_2{=}C(R^1){-}C(O){-}O{-}[CH_2{-}CH(R^2)O]_m{-}[CH(R^3){-}CH_2O]_n{-}R^4$$

in which $R^1$ is a hydrogen atom or a methyl radical $R^2$ and $R^3$, which may be identical or different, represent a hydrogen atom or an alkyl radical containing from 1 to 4 carbon atoms $^4$ is an alkyl radical containing from 8 to 30 carbon atoms a phenyl radical substituted with 1 to 3 1-phenylethyl groups an alkylphenyl radical containing from 8 to 10 carbon atoms n ranges from 6 to 100 and m ranges from 0 to 50, with the proviso that n is greater than or equal to m and their sum is between 6 and 100.

Mention may be made most particularly of the amphiphilic comonomers described in EP-A-705 854 and U.S. Pat. No. 4,384,096, in particular the grafting comonomer (MG') of the above formula, in which $R^1$ is a methyl radical, $R^2$ is a hydrogen atom, m is equal to 25, n is equal to zero and $R^4$ is a $C_{22}H_{45}$ alkyl radical.

Examples of alkali-water-soluble copolymers (AS) which may be mentioned in particular are copolymers derived from a monomer composition consisting of acrylic and/or methacrylic esters and of at least 30% acrylic and/or methacrylic acid from said monomer composition also containing a glyoxal bis acrylamide or ethylene glycol dimethacrylate crosslinking comonomer from said monomer composition also containing the grafting comonomer (MG').

For good implementation of the invention, said water-dispersible granules (G) comprise:

from 5% to 90%, preferably from 40% to 85%, of their weight of particles (pS) of system (S)

from 3% to 90%, preferably from 10% to 60% and most particularly from 15% to 50%, of water-soluble or water-dispersible organic matrix (MO).

Among the water-soluble or water-dispersible organic compounds which can constitute the matrix (MO), mention may be made of water-soluble or water-dispersible polypeptides (PP) of natural or synthetic origin polyelectrolytes (PE) in acid form, belonging to the family of weak polyacids, having a molecular mass of less than 20,000 g/mol, preferably between 1000 g/mol and 5000 g/mol water-soluble or water-dispersible oses, osides or polyholosides (O)

water-soluble or water-dispersible amino acids or amino acid salts (AA)

surfactants (TA) whose water-surfactant binary phase diagram comprises an isotropic phase which is fluid at 25° C. up to a concentration of at least 50% by weight of surfactant, followed by a rigid liquid crystal phase of hexagonal or cubic type at higher concentrations, which is stable at least up to 60° C., or mixtures thereof.

Among the water-soluble or water-dispersible synthetic polypeptides (PP) which can constitute the shell, mention may be made of homopolymers or copolymers derived from the polycondensation of amino acids or amino acid precursors, in particular of aspartic acid and glutamic acid or precursors thereof, and hydrolysis. These polymers can be not only homopolymers derived from aspartic acid or glutamic acid but also copolymers derived from aspartic acid and glutamic acid in all proportions, or copolymers derived from aspartic acid and/or glutamic acid and from other amino acids. Among the copolymerizable amino acids which may be mentioned are glycine, alanine, leucine, isoleucine, phenylalanine, methionine, histidine, proline, lysine, serine, threonine, cysteine, etc.

Among the polypeptides (PP) of plant origin which can constitute the matrix, mention may be made of proteins of plant origin; these are preferably hydrolyzed, with a degree of hydrolysis of less than or equal to 40%, for example from 5% to less than 40%.

Among the proteins of plant origin which may be mentioned as a guide are proteins originating from proteaginous seeds, in particular those of pea, bean, lupin, haricot and lentil; proteins originating from cereal seeds, in particular those of wheat, barley, rye, corn, rice, oat and millet; proteins originating from oleaginous seeds, in particular those of soya, groundnut, sunflower, rape and coconut; proteins originating from leaves, in particular from alfalfa and nettles; and proteins originating from underground reserves of plant organs, in particular those of potato and beetroot.

Among the proteins of animal origin which may be mentioned, for example, are muscle proteins, in particular proteins of the stroma, and gelatin; proteins originating from milk, in particular casein and lactoglobulin; and fish proteins.

The protein is preferably of plant origin, and more particularly originates from soya or wheat.

The polyelectrolyte (PE) can be chosen from those derived from the polymerization of monomers which have the following general formula $$(R^1)(R^2)C{=}C(R^3)COOH$$

in which general formula $R^1$, $R^2$ and $R^3$ are identical or different and represent a hydrogen atom, a hydrocarbon-based radical containing from 10 to 4 carbon atoms, preferably methyl, a —COOH function, a radical —R—COOH, in which R represents a hydrocarbon-based residue containing from 1 to 4 carbon atoms, preferably an alkylene residue containing 1 or 2 carbon atoms, most particularly methylene.

Non-limiting examples which may be mentioned are acrylic acid, methacrylic acid, maleic acid, fumaric acid, itaconic acid and crotonic acid.

Copolymers obtained from monomers corresponding to the above general formula and those obtained using these monomers and other monomers, in particular vinyl derivatives such as vinyl alcohols and copolymerizable amides such as acrylamide or methacrylamide, are also suitable for use. Mention may also be made of the copolymers obtained from alkyl vinyl ether and from maleic acid as well as those obtained from vinylstyrene and maleic acid, which are described in particular in the Kirk-Othmer encyclopedia "Encyclopedia of Chemical Technology"—Volume 18—3rd Edition—Wiley Interscience Publication—1982.

The preferred polyelectrolytes have a low degree of polymerization. The weight-average molecular mass of the polyelectrolytes is more particularly less than 20,000 g/mol. Preferably, it is between 1000 and 5000 g/mol.

Among the oses (O) which may be mentioned are aldoses such as glucose, mannose, galactose and ribose, and ketoses such as fructose.

Osides are compounds which result from the condensation, with elimination of water, of ose molecules with each other or of ose molecules with non-carbohydrate molecules. Among the preferred osides are holosides which are formed by combining exclusively carbohydrate units and more particularly oligoholosides (or oligosaccharides) which comprise only a limited number of these units, i.e. a number generally less than or equal to 10. Examples of oligoholosides which may be mentioned are sucrose, lactose, cellobiose, maltose and trehalose.

The water-soluble or water-dispersible polyholosides (or polysaccharides) are highly depolymerized; they are described, for example, in the book by P. Arnaud entitled "Cours de Chimie Organique", edited by Gaultier-Villars, 1987. These polyholosides more particularly have a weight-average molecular mass of less than 20,000 g/mol.

Non-limiting examples of highly depolymerized polyholosides which may be mentioned are dextran, starch, xanthan gum and gallactomannans such as guar or carob, these polysaccharides preferably having a melting point of greater than 100° C. and a solubility in water of between 50 g/l and 500 g/l.

Among the amino acids (AA) which may be mentioned are monocarboxylic or dicarboxylic monoamino acids, monocarboxylic diamino acids and water-soluble derivatives thereof.

The amino acids (AA) preferably have a side chain with acid-base properties; they are chosen in particular from arginine, lysine, histidine, aspartic acid, glutamic acid and hydroxyglutamic acid; they can also be in the form of derivatives, preferably water-soluble derivatives; they can be, for example, sodium, potassium or ammonium salts, such as sodium glutamate, aspartate or hydroxyglutamate.

As regards the surfactants (TA) which can constitute the organic matrix (MO), the description of the fluid isotropic phase and rigid liquid crystal phase of hexagonal or cubic type is given in the book by R. G. Laughlin entitled "The Aqueous Phase Behavior of Surfactants"—Academic Press—1994. Their identification by radiation (X-ray and neutrons) scattering is described in the book by V. Luzzati entitled "Biological Membranes, Physical Fact and Function"—Academic Press—1968.

The rigid liquid crystal phase is more particularly stable up to a temperature at least equal to 55° C. The fluid isotropic phase can be cast, while the rigid liquid crystal phase cannot be.

Among the surfactants (TA) which may be mentioned are ionic glycolipid surfactants, in particular uronic acid derivatives (galacturonic acid, glucuronic acid, D-mannuronic acid, L-iduronic acid, L-guluronic acid, etc.), containing a substituted or unsubstituted, saturated or unsaturated hydrocarbon-based chain containing from 6 to 24 carbon atoms and preferably from 8 to 16 carbon atoms, or salts thereof. Products of this type are described in particular in patent application EP 532 370.

Other examples of surfactants (TA) are amphoteric surfactants such as amphoteric derivatives of alkyl polyamines such as Amphionic XL® and Mirataine H2C-HA® sold by Rhône-Poulenc, as well as Ampholac 7T/X® and Ampholac 7C/X® sold by Berol Nobel.

The granules (G) comprise at least 0.1% by weight, relative to the weight of alkali-water-soluble polymer (AS), of at least one emulsifier, present at the interface: matrix (MO)/particles (pS) of system (S).

Examples of emulsifiers which may be mentioned are nonionic, anionic or amphoteric emulsifiers.

Among the nonionic emulsifiers which may be mentioned in particular are polyoxyalkylenated derivatives such as

- ethoxylated or ethoxy-propoxylated fatty alcohols
- ethoxylated or ethoxy-propoxylated triglycerides
- ethoxylated or ethoxy-propoxylated fatty acids
- ethoxylated or ethoxy-propoxylated sorbitan esters
- ethoxylated or ethoxy-propoxylated fatty amines
- ethoxylated or ethoxy-propoxylated di(1-phenylethyl)-phenols
- ethoxylated or ethoxy-propoxylated tri(1-phenyl-ethyl) phenols
- ethoxylated or ethoxy-propoxylated alkylphenols.

The number of oxyethylene (OE) and/or oxypropylene (OP) units in these nonionic surfactants usually ranges from 2 to 100 depending on the desired HLB (hydrophilic/lipophilic balance). The number of OE and/or OP units is more particularly between 2 and 50.

The number of OE and/or OP units is preferably between 10 and 50.

The ethoxylated or ethoxy-propoxylated fatty alcohols generally comprise from 6 to 22 carbon atoms, the OE and OP units being excluded from these numbers. These units are preferably ethoxylated units.

The ethoxylated or ethoxy-propoxylated triglycerides can be triglycerides of plant or animal origin (such as lard, tallow, groundnut oil, butter oil, cottonseed oil, flax oil, olive oil, fish oil, palm oil, grapeseed oil, soybean oil, castor oil,, rapeseed oil, copra oil or coconut oil and are preferably ethoxylated.

The ethoxylated or ethoxy-propoxylated fatty acids are esters of fatty acids (such as, for example, oleic acid or stearic acid), and are preferably ethoxylated.

The ethoxylated or ethoxy-propoxylated sorbitan esters are cyclized sorbitol esters of fatty acid comprising from 10 to 20 carbon atoms such as lauric acid, stearic acid or oleic acid, and are preferably ethoxylated.

In the present invention, the term "ethoxylated triglyceride" targets not only the products obtained by ethoxylation of a triglyceride with ethylene oxide but also those obtained by transesterification of a triglyceride with a polyethylene glycol.

Similarly, the term "ethoxylated fatty acid" includes not only the products obtained not ethoxylation of a fatty acid with ethylene oxide but also those obtained by transesterification of a fatty acid with a polyethylene glycol.

The ethoxylated or ethoxy-propoxylated fatty amines generally contain from 10 to 22 carbon atoms, the OE and OP units being excluded from these numbers, and are preferably ethoxylated.

The ethoxylated or ethoxy-propoxylated alkyl phenols are generally 1 or 2 linear or branched alkyl groups containing 4 to 12 carbon atoms. Examples which may be mentioned in particular are octyl, nonyl or dodecyl groups.

Examples of nonionic surfactants from the group of ethoxy or ethoxy-propoxylated alkyl phenols, ethoxylated di(1-phenylethyl)phenols and ethoxy or ethoxy-propoxylated tri(1-phenylethyl)phenols which may be mentioned in particular are di(1-phenylethyl)phenol ethoxylated with 5 OE units, di(1-phenylethyl)phenol ethoxylated with 10 OE units, tri(1-phenylethyl)phenol ethoxylated with 16 OE units, tri(1-phenylethyl)phenol ethoxylated with 20 OE units, tri(1-phenylethyl)phenol ethoxylated with 25 OE units, tri(1-phenylethyl)phenol ethoxylated with 40 OE units, tri(1-phenylethyl)phenols ethoxy-propoxylated with 25 OE+OP units, nonylphenol ethoxylated with 2 OE units, nonylphenol ethoxylated with 4 OE units, nonylphenol ethoxylated with 6 OE units, nonylphenol ethoxylated with 9 OE units, nonylphenols ethoxy-propoxylated with 25 OE+OP units, nonylphenols ethoxy-propoxylated with 30 OE+OP units, nonyplhenols ethoxy-propoxylated with 40 OE+OP units, nonylphenols ethoxy-propoxylated with 55 OE+OP units and nonylphenols ethoxy-propoxylated with 80 OE+OP units.

Among the anionic emulsifiers which may be mentioned are water-soluble salts of alkyl sulfates and of alkyl ether sulfates, alkyl isethionates and alkyl taurates or salts thereof, alkyl carboxylates, alkyl sulfosuccinates or alkyl succinamates, alkyl sarcosinates, alkyl derivatives of protein hydrolyzates, acyl aspartates, and alkyl and/or alkyl ether and/or alkylaryl ether phosphate esters.

The cation is generally an alkali metal or alkaline-earth metal, such as sodium, potassium, lithium or magnesium, or an ammonium group $NR_4^+$ with R, which may be identical or different, representing an alkyl radical substituted or unsubstituted with an oxygen or nitrogen atom.

Among the amphoteric emulsifiers which may be mentioned are alkylbetaines, alkyldimethylbetaines, alkylamidopropylbetaines, alkylamidopropyldimethylbetaines, alkyltrimethylsulfobetaines, imidazoline derivatives such as alkyl amphoacetates, alkyl amphodiacetates, alkyl amphopropionates, alkyl amphodipropionates, alkylsultaines or alkylamidopropylhydroxysultaines, the condensation products of fatty acids and of protein hydrolyzates, amphoteric derivatives of alkylpolyamines such as Amphionic XL® sold by Rhône-Poulenc, Ampholac 7T/X® and Ampholac 7C/X® sold by Berol Nobel, and proteins or protein hydrolyzates.

When the organic compound (MO) is a polypeptide (PP) or an amino acid (AA), said emulsifier is chosen from anionic and amphoteric emulsifiers. When the organic compound (MO) is a polyelectrolyte (PE), said emulsifier is chosen from nonionic and amphoteric emulsifiers. When the organic compound (MO) is an ose, oside or polyholoside (O), said emulsifier is chosen from anionic emulsifiers.

Said dry solid granules (G) can be obtained by elimination of water/drying of an aqueous dispersion (D) comprising said particles (pS) of system (S) and said water-soluble or water-dispersible organic compound capable of forming the matrix (MO).

For good implementation of the process, the solids content of the aqueous dispersion (D) comprising the mixture of particles (pS) and of organic compound (MO) is from about 20% to 70%, preferably from about 30% to 60% by weight.

Said process can be carried out by adding at least one organic compound (MO) and optionally one dispersant to an aqueous dispersion (latex) (LS) of particles (pS)

followed by elimination of water/drying of the aqueous dispersion obtained.

Said dispersion (latex) (LS) of particles (pS) of system (S) can contain from about 10% to 50%, preferably from about 20% to 50%, of its weight of said particles (pS) of system (S).

The diameter of the particles (pS) of system (S) can be from about 20 nanometers to 700 nanometers, preferably from about 100 nanometers to 400 nanometers.

The aqueous dispersion (LS) of system (S) can be prepared by introducing said active material (AM) into said alkali-water-soluble polymer (AS) which is in the form of a latex (LAS), it being possible for the introduction of the active material (AM) to be carried out either during the synthesis itself of said alkali-water-soluble polymer by aqueous emulsion polymerization, or after the synthesis of said alkali-water-soluble polymer by aqueous emulsion polymerization.

The introduction of the active material (AM) into the alkali-soluble polymer latex (LAS) is preferably carried out after the step of aqueous emulsion polymerization of the monomer composition.

The particles (pAS) of the latex (LAS) have at their surface at least one emulsifier, in a content of at least 0.1%, generally from about 0.1% to 15%, of the weight of dry polymer. This emulsifier content depends on the size of the latex particles.

Examples of emulsifiers which may be mentioned are:

anionic emulsifiers such as: fatty acid salts; alkyl sulfates (sodium lauryl sulfate), alkyl sulfonates, alkylaryl sulfonates (sodium dodecylbenzene sulfonates, sodium dibutylnaphthalene sulfonate), alkyl sulfosuccinates or succinamates (disodium dioctyl sulfosuccinamate, disodium n-octadecyl sulfosuccinamate), alkaline alkyl phosphates; sodium dodecyl diphenyl ether disulfonate; alkylphenylpolyglycol ether sulfonates; alkylsulfopolycarboxylic acid ester salts; the condensation products of fatty acids with oxy- and amino-alkanesulfonic acids; sulfate derivatives of polyglycol ethers; sulfate esters of fatty acids and of polyglycols; fatty acid alkanolamide sulfates;

nonionic emulsifiers such as ethoxylated or ethoxy-propoxylated fatty alcohols
ethoxylated or ethoxy-propoxylated triglycerides
ethoxylated or ethoxy-propoxylated fatty acids
ethoxylated or ethoxy-propoxylated sorbitan esters
ethoxylated or ethoxy-propoxylated fatty amines
ethoxylated or ethoxy-propoxylated di(1-phenylethyl) phenols
ethoxylated or ethoxy-propoxylated tri(1-phenylethyl) phenols
ethoxylated or ethoxy-propoxylated alkylphenols
polyethylene oxides
fatty acid alkanolamides.

Among the amphoteric emulsifiers which may be mentioned are alkylbetaines, alkyldimethylbetaines, alkylamidopropylbetaines, alkylamidopropyldimethylbetaines, alkyltrimethylsulfobetaines, imidazoline derivatives such as alkyl amphoacetates, alkyl amphodiacetates, alkyl amphopropionates, alkyl amphodipropionates, alkylsultaines or alkylamidopropylhydroxysultaines, condensation products of fatty acids and of protein hydrolyzates, amphoteric derivatives of alkylpolyamines such as Amphionic XL® sold by Rhône-Poulenc, Ampholac 7T/X® and Ampholac 7C/X® sold by Berol Nobel, and proteins or protein hydrolyzates.

Said emulsifier is preferably anionic or nonionic.

The active material (AM) present in liquid form can be introduced directly into the latex (LAS) of alkali-water-soluble polymer, if it "swells" the polymer sufficiently, or aided, if necessary, by a swelling "transfer" solvent for the polymer.

Among the transfer solvents which may be mentioned are esters such as ethyl acetate, methyl propionate, a mixture of methyl glutarate/adipate/succinate ("RPDE" solvent), etc., ketones such as methyl ethyl ketone, cyclohexanone, etc.,
alcohols such as propanol, pentanol, cyclohexanol, etc.,
aliphatic and cyclic hydrocarbons such as heptane, decane, cyclohexane, decalin, etc.,
chlorinated aliphatic derivatives such as dichloromethane, etc.,
aromatic derivatives such as toluene, ethylbenzene, etc.,
chlorinated aromatic derivatives such as trichlorobenzene, etc.,
dialkyl ethers.

An additional amount of emulsifier, in particular of polyoxyalkylenated nonionic emulsifier, of the type already mentioned above, can be added, if necessary, to the latex (LAS) of alkali-water-soluble polymer. This additional amount can represent from a bout 0.1% to 2%, preferably from about 0.1% to 0.2%, of the weight of the active material (AM) used.

The active material (AM) introduced is placed in contact with the latex (LAS) with stirring at a temperature from 20° C. to 50° C. for 1 to 24 hours.

Said "transfer" solvent can optionally be removed by evaporation under vacuum if the active material (AM) is a solid.

The organic compound (MO) is then added to the latex (LS) of system (S) optionally along with a dispersant.

The amount of optional dispersant can be from about 0.02% to 20% by weight relative to the weight of dry alkali-water-soluble polymer (AS). The presence of a dispersant is generally favorable, in particular when the organic compound (MO) is not a surfactant (TA) or a protein.

Among the dispersants which can be used, mention may be made of nonionic, anionic or amphoteric emulsifiers; examples of such emulsifiers have already been mentioned above.

When the organic compound (MO) is a polypeptide (PP) or an amino acid (AA), said emulsifier is chosen from anionic and amphoteric emulsifiers. When the organic compound (MO) is a polyelectrolyte (PE), said emulsifier is chosen from nonionic and amphoteric emulsifiers. When the organic compound (MO) is an ose, and oside or polyholoside (O), said emulsifier is chosen from anionic emulsifiers.

The operation for removal of water/drying of the aqueous dispersion of particles (ps) and of organic compound (MO) can be carried out according to any means known to those skilled in the art, in particular by lyophilization (i.e. freezing followed by sublimation) or, preferably, by spray-drying.

The spray-drying can be carried out in any known machine, such as a spraying tower combining spraying carried out by a nozzle or a turbomixer with a stream of hot air. The implementation conditions depend on the type of active material, the type of organic compound (MO) matrix and of sprayer used; these conditions are generally such that the temperature of the whole product during drying does not exceed 150° C. and preferably does not exceed 110° C.

The granules (G) are water-dispersible at ambient temperature, by simple stirring, to give a pseudolatex of system (S).

Said granules (G) can optionally also contain an anticaking agent or a filler, such as, in particular, calcium carbonate, kaolin, silica, a bentonite, etc., which can be added partially or totally either to the aqueous dispersion before elimination of the water, or during the spraying step or else to the final granule composition.

The system (S) forming the subject of the invention can be used as an additive in compositions intended for an alkaline aqueous medium or capable of forming an alkaline aqueous medium with water, in particular such as a detergent additive in detergent compositions, preferably in powder form, in particular for cleaning hard surfaces or for washing laundry (industrial or household washing).

In particular, another subject of the invention consists of the use, in detergent compositions, in particular for cleaning hard surfaces or for washing laundry (industrial or household washing), of granules of system (S), as detergent additive.

Said granules (G) of system (S) can generally be used according to amounts corresponding to the doses of active material usually encapsulated that are used in the detergent compositions.

A final subject of the invention consists of detergent compositions for cleaning hard surfaces or for washing laundry (industrial or household washing), comprising said granules (G) of system (S).

The detergent compositions according to the invention comprise at least one surfactant preferably chosen from anionic and nonionic surfactants, in an amount generally from about 1% to 70% by weight, preferably from 5% to 60% by weight and more particularly from 8% to 50% by weight.

The detergent compositions forming the subject of the invention can also comprise common additives, such as inorganic or organic detergent adjuvants ("builders"), in an amount such that the total amount of detergent adjuvant is from about 5% to 80% of the weight of said composition, preferably from 8% to 40% by weight, anti-soiling agents, anti-redeposition agents, bleaching agents, fluorescence agents, foam suppressants, softeners, enzymes and other additives such as alcohols, buffers, fillers, pigments, etc.

The examples which follow are given for illustrative purposes.

EXAMPLE 1

Characteristics of the encapsulation latex

| * starting monomer composition | (% by weight) |
|---|---|
| . butyl acrylate | 10% |
| . ethyl acrylate | 56.4% |
| . methacrylic acid | 33.6% |

emulsifiers 0.955% relative to the monomers as a whole (0.015% of ethoxylated nonylphenol containing 25 OE units on average per mole, in the form of ammonium salt+0.94% of sodium tetrapropylbenzene sulfonate)

solids content=38.9% particle diameter=about 200 nanometers.

A solution containing 400 g/l of triclosan in RPDE solvent is prepared.

A mixture is prepared by introducing 0.8 ml of RPDE and 2 ml of Rhodasurf T (nonionic surfactant from Rhône-Poulenc) at a concentration of 5 g/l into 20 g of the above latex, and this mixture is brought to 50° C.

5 ml of the triclosan solution are introduced dropwise into this mixture, with mechanical stirring.

The medium is left stirring at 50° C. for 1 hour and then for 1 hour at ambient temperature.

An encapsulated biocidal system in the form of a latex is thus obtained.

EXAMPLE 2

The following dispersion is prepared in a mixer:

| Composition | % by weight |
|---|---|
| encapsulated biocidal system, in the form of a latex, of Example 1 (expressed as aqueous dispersion) | 89% |
| Amphionic XL* (sold by Rhodia) | 2.1% |
| polyacrylic acid (Mw = 2000) | 8.9% |

* solution of alkyl aminocarboxylate in water, containing 40% solids, including 10% of sodium chloride 1kg of this dispersion is sprayed under standard conditions in a Niro ® spraying column (115° C. at the inlet and 60° C. at the outlet). A flowable powder is obtained.

EXAMPLE 3

The following dispersion is prepared in a mixer;

| Composition | % by weight |
|---|---|
| encapsulated biocidal system, in the form of a latex, of Example 1 (expressed as aqueous dispersion) | 85.4% |
| FP940* | 1.4% |
| FP900** | 13.2% |

* soya protein hydrolyzate with a degree of hydrolysis of less than 5%, from Protein Technologies International
**soya protein hydrolyzate with a degree of hydrolysis of 15%, from Protein Technologies International 1kg of this dispersion is sprayed under standard conditions in a Niro ® spraying column (115° C. at the inlet and 60° C. at the outlet). A flowable powder is obtained.

EXAMPLE 4

The following dispersion is prepared in a mixer:

| Composition | % by weight |
|---|---|
| encapsulated biocidal system, in the form of a latex, of Example 1 (expressed as aqueous dispersion) | 89% |
| FP940* | 1.4% |
| FP900** | 6.6 |
| Sucrose | 6.6 |

1 kg of this dispersion is atomized under standart conditions in a Niro® spraying column (115° C. at the inlet and 60° C. at the outlet). A flowable powder is obtained.

What is claimed is:

1. Water-dispersible dry solid granules of a system comprising particles comprising at least one hydrophobic organic active material encapsulated in solid particles of an alkali-water-soluble organic polymer obtained by emulsion polymerization of at least one ethylenically unsaturated anionic monomer which is a is an α,β-ethylenically unsaturated carboxylic acid and which can undergo radical-mediated polymerization and of at least one ethylenically unsaturated nonionic comonomer which is an alkyl ester of α,β-ethylenically unsaturated acid, and which can undergo radical-mediated polymerization, the amount of said anionic monomer(s) representing at least 10%, by weight of the total amount of monomers, said particles being dispersed in and encapsulated by a matrix made of at least one water-soluble or water-dispersible dry solid organic compound which is a surfactant whose water-surfactant binary phase diagram comprises an isotropic phase which is fluid at 25° C. up to a concentration of at least 50% by weight of surfactant, followed by a rigid liquid crystal phase of hexagonal or cubic type at higher concentrations, which is stable at least up to 60° C., at least 0.1% by weight of at least one emulsifier relative to the weight of said alkali-water-soluble copolymer being present at the interface: matrix particles of the system.

2. Granules according to claim 1, wherein the amount of said anionic monomer(s) represents from 25% to 60%, by weight of the total amount of monomers.

3. Granules according to claim 1, wherein the active material is a detergent active material.

4. Granules according to claim 1, wherein the active material is a bleaching catalyst, biocide, bleaching activator, anti-UV agent, optical brightener, or antioxidant.

5. Granules according to claim 1, wherein the amount of the active material ranges from 20 to 70 by weight of active material per 100 parts by weight of the alkali-water-soluble polymer.

6. Granules according to claim 5, wherein the amount of the active material ranges from 40 to 60 parts.

7. Granules according to claim 1, wherein the alkali-water-soluble polymer is capable of dissolving or dispersing in an aqueous medium with a pH of greater than 7, at a temperature from about 20° C. to 90° C.

8. Granules according to claim 1, wherein the anionic monomer is acrylic acid, methacrylic acid, maleic acid, or itaconic acid.

9. Granules according to claim 1, wherein the alkali-water-soluble polymers are derived from a monomer composition also containing at least one polyfunctional crosslinking comonomer or at least one ethylenically unsaturated nonionic amphiphilic comonomer capable of forming grafted copolymers with the other comonomers.

10. Granules according to claim 9, wherein the polyfunctional crosslinking comonomer(s) represent(s) from about 0.01% to 1%, of all of the monomers in the monomer composition.

11. Granules according to claim 10, wherein the polyfunctional crosslinking comonomer(s) represent(s) from 0.01% to 0.5%, of all of the monomers in the monomer composition.

12. Granules according to claim 9, wherein the grafting nonionic amphiphilic comonomer(s) represent(s) up to 20% of all of the monomers.

13. Granules according to claim 9, wherein the grafting nonionic amphiphilic comonomer has the formula $$CH_2{=}C(R^1){-}C(O){-}O{-}[CH_2{-}CH(R^2)O]_m{-}[CH(R^3){-}CH_2O]_n{-}R^4$$

wherein:

$R^1$ is a hydrogen atom or a methyl radical, $R^2$ and $R^3$, which are identical or different, represent a hydrogen atom or an alkyl radical containing from 1 to 4 carbon atoms, $R^4$ is an alkyl radical containing from 8 to 30 carbon atoms, a phenyl radical substituted with 1 to 3 1-phenylethyl groups, an alkylphenyl radical containing from 8 to 10 carbon atoms, and n ranges from 6 to 100 and m ranges from 0 to 50, with the proviso that n is greater than or equal to m and their sum is between 6 and 100.

14. Granules according to claim 9, wherein the alkali-water-soluble polymer is derived from:

a monomer composition consisting of acrylic or methacrylic esters and of at least 30% acrylic or methacrylic acid, a monomer composition consisting of acrylic or methacrylic esters and of at least 30% acrylic or methacrylic acid, and a glyoxal bis acrylamide or ethylene glycol dimethacrylate crosslinking comonomer, or a monomer composition consisting of acrylic or methacrylic esters and of at least 30% acrylic or methacrylic acid, and a grafting comonomer of formula $$CH_2{=}C(R^1){-}C(O){-}O{-}[CH_2{-}CH(R^2)O]_m{-}[CH(R^3){-}(CH_2O]_n{-}R^4$$

wherein:

$R^1$ is a methyl radical, $R^2$ is a hydrogen atom, m is equal to 25, n is equal to zero and $R^4$ is a $C_{22}H_{45}$ alkyl radical.

15. Granules according to claim 1, comprising:

from 5% to 90%, of their weight of particles of the system (S), and from 3% to 90%, of their weight of the water-soluble or water-dispersible organic matrix.

16. Granules according to claim 15, comprising:

from 40% to 85%, of their weight of particles of the system (S), and from 15% to 50%, of their weight of the water-soluble or water-dispersible organic matrix.

17. A process for preparing the granules as defined in claim 1, by elimination of water or drying of an aqueous dispersion comprising said particles of the system (S) and said water-soluble or water-dispersible organic compound capable of forming the matrix.

18. A process according to claim 17, wherein the dispersion is obtained by adding the organic compound and, optionally, one dispersant to an aqueous dispersion of particles.

19. A process according to claim 17, wherein the dispersion comprises from 5% to 90%, by dry weight of water-soluble or water-dispersible organic matrix.

20. A process according to claim 17, wherein said dispersion has a solids content of from 20% to 70% by weight.

21. A process according to claim 17, wherein the dispersion contains from about 10% to 50%, of its weight of the particles with a diameter of about 20 nanometers to 700 nanometers.

22. A process according to claim 17, wherein the dispersion is obtained by adding said active material into the particles of the alkali-water-soluble polymer by placing said active material in contact, optionally using a transfer solvent, with said alkali-water-soluble polymer which is in the form of a latex of the particles containing at their surface at least one emulsifier, in a content of at least 0.1 of the

23. A process according to claim 22, wherein the addition of said active material is carried out together with that of an additional amount of emulsifier representing from about 0.1% to 2% of the weight of active material used.

24. A process according to claim 22, wherein the addition of said active material by placing in contact with the latex is carried out with stirring at a temperature from 20° C. to 50° C. for 1 to 24 hours.

25. A process according to claim 17, wherein the amount of optional dispersant in the dispersion is from about 0.02% to 20% by weight relative to the weight of dry alkali-water-soluble polymer.

26. A process according to claim 17, in the drying of the dispersion is carried out by lyophilization or by spraying.

27. A process according to claim 17, wherein anticaking agents are further added during the drying step.

28. Detergent compositions, for cleaning hard surfaces or for washing laundry, comprising the granules as defined in claim 1.

* * * * *